United States Patent [19]

Gill

[11] 3,990,757

[45] Nov. 9, 1976

[54] CONNECTING DEVICE

[75] Inventor: Lawrence H. Gill, Depew, N.Y.

[73] Assignee: Carleton Controls Corporation, East Aurora, N.Y.

[22] Filed: Dec. 11, 1975

[21] Appl. No.: 639,866

[52] U.S. Cl. ..... 339/11; 339/75 R; 339/252 R

[51] Int. Cl.[2] ..... H01R 33/00

[58] Field of Search ..... 339/11, 75 R, 75 A, 339/76, 77, 79, 80, 82, 91 R, 247, 252 R, 252 P, 253 R

[56] References Cited

UNITED STATES PATENTS

| | | | |
|---|---|---|---|
| 3,065,449 | 11/1962 | Matthysse et al. | 339/247 |
| 3,865,458 | 2/1975 | Pauza et al. | 339/91 R |
| 3,885,850 | 5/1975 | Witte et al. | 339/91 R |

*Primary Examiner*—W. Tupman
*Assistant Examiner*—DeWalden W. Jones
*Attorney, Agent, or Firm*—Sommer & Sommer

[57] ABSTRACT

A connecting device is adapted to releasably hold a portion of a first object, such as a pilot's oxygen mask, to a portion of a second object, such as a pilot's helmet. The connecting device broadly includes an anchor member mounted on the mask, a housing member mounted on the helmet and having a female passageway, a male member adapted to be inserted into the female passageway, and a cable member having one marginal end portion secured to the anchor member and another marginal end portion secured to the male member. The housing member has a toothed pawl section biased to move into the female passageway. The male member has a ratchet rack adapted to engage the pawl section to prevent unintended separation of the male member from the female passageway. The male member includes a release member movably mounted relative to the rack, and having an operative surface adapted to extend beyond the rack teeth. The release member may be selectively moved relative to the rack to disengage the mating teeth of the rack and pawl section to permit the male member to be withdrawn from the female passageway.

13 Claims, 18 Drawing Figures

CONNECTING DEVICE

BACKGROUND OF THE INVENTION

1. Field of the Invention

The present invention relates generally to a connecting device for releasably holding a first object to a second object, and more particularly to an improved connecting device which is particularly adapted to releasably hold a pilot's oxygen mask to the pilot's helmet.

2. Description of the Prior Art

Since the Second World War, military pilots have commonly used the "elephant trunk"-type of oxygen mask, and the means for connecting this mask to the pilot's helmet generally comprised a series of straps and buckles. This type of device for connecting the mask to the helmet was somewhat cumbersome for the pilot to adjust in flight, particularly if he was wearing gloves.

More recently, an improved oxygen supply system has been developed in which the oxygen supply conduit penetrates the back of the pilot's helmet and communicates with the side of the mask. The principal advantage of this improved mask and helmet design lies in reduction of the torque attributable to the weight of the old "elephant trunk"-type of conduit, a factor which had contributed to pilot fatigue.

Additional details of this improved mask and helmet design may be found on page 22 et seq. of the Spring Quarter, 1974 issue of a publication entitled "SAFE Journal", this being the Journal of the Survival and Flight Equipment Association.

SUMMARY OF THE INVENTION

The present invention overcomes the deficiencies of the old strap and buckle type system for releasably connecting an oxygen mask to a pilot's helmet.

The inventive connecting device is generally adapted to releasably hold a first object to a second object, and, in one form, may include: an anchor member mounted on, or connected to, the first object; a cable member having one marginal end portion suitably secured to the anchor member and having another marginal end portion; a housing member mounted on, or connected to, the second object and provided with a female passageway and further including a toothed section biased to move into the female passageway; and a male member suitably secured to the other marginal end portion of the cable member and adapted to be selectively inserted into the female passageway. The male member includes a toothed ratchet rack adapted to matingly engage the toothed section when the male member is inserted into the female passageway to prevent unintended separation or withdrawal of the male member from the housing member. The male member further includes a release member mounted for movement relative to the rack. The release member has at least one first cam surface arranged to slidably engage at least one second cam surface, which is stationary with respect to the rack. When the release member is moved relative to the rack, the sliding engagement between these cam surfaces causes an operative surface of the release member to move beyond the teeth of the rack to overcome the bias exerted on the toothed pawl section and to urge it to retract, thereby disengaging the toothed section from the rack and allowing the male member to be withdrawn or removed from the housing member.

Thus, an operator may connect the first and second objects by simply inserting the male member into the female passageway such that the ratchet rack teeth will matingly engage the teeth of the biased pawl, and may release the first and second objects by first selectively moving the release member relative to the rack to cause the release member operative surface to disengage the toothed section from the toothed rack and then withdrawing the male member from the female passageway.

Alternatively, the inventive connecting device may simply include the housing member, suitably connected to or mounted on one of the objects, and the male member, suitably connected to or mounted on the other of the objects.

Accordingly, one principal object of the present invention is to provide an improved connecting device which is generally adapted to releasably hold or connect a first object to a second object.

Another specific object is to provide an improved connecting device which is particularly adapted to releasably hold an oxygen mask to a pilot's helmet.

Another specific object is to provide an improved connecting device for releasably holding an oxygen mask to a pilot's helmet which affords the capability of ease of inflight adjustment by the pilot.

Still another general object is to provide an improved connecting device which is simple to operate, relatively inexpensive to manufacture, and which results in a more facile combination than prior art connecting devices.

These and other objects and advantages will become apparent from the foregoing and ongoing specification, the drawings, and the appended claims.

BRIEF DESCRIPTION OF THE DRAWING FIGURES

DESCRIPTION OF THE PREFERRED EMBODIMENTS

Figure 1:
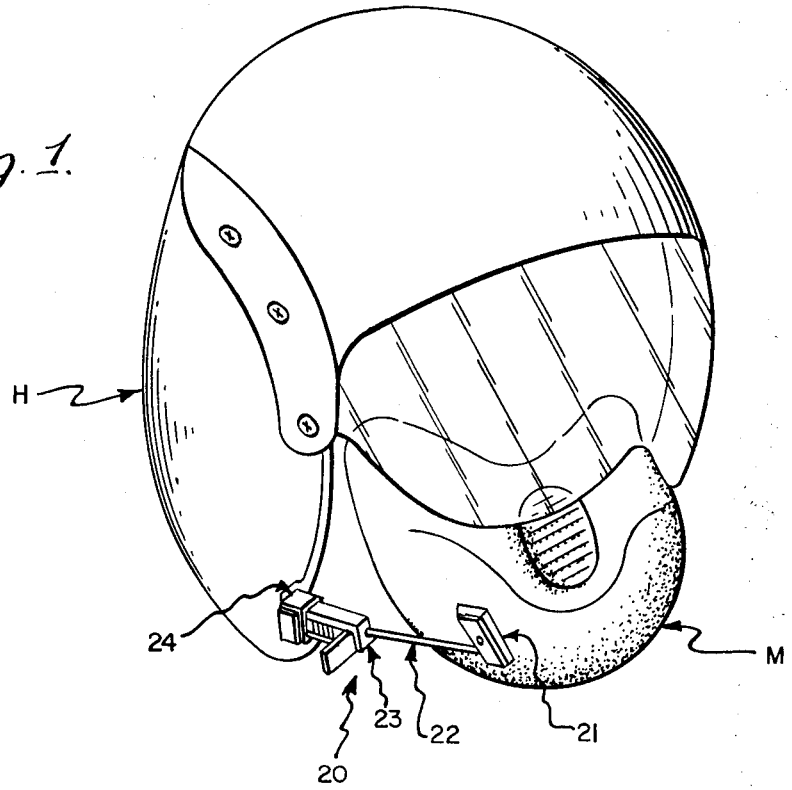
FIG. 1 is a perspective right front view of a pilot's helmet and mask, this view illustrating the first preferred embodiment of the inventive connecting device as releasably holding a right side portion of the mask to a right side portion of the helmet.

At the outset, it should be clearly understood that like reference numerals are intended to identify the same elements and/or structure consistently throughout the several drawing figures, as such elements and/or structure may be further described or explained by the entire written specification of which this detailed description is an integral part.

Figure 2:
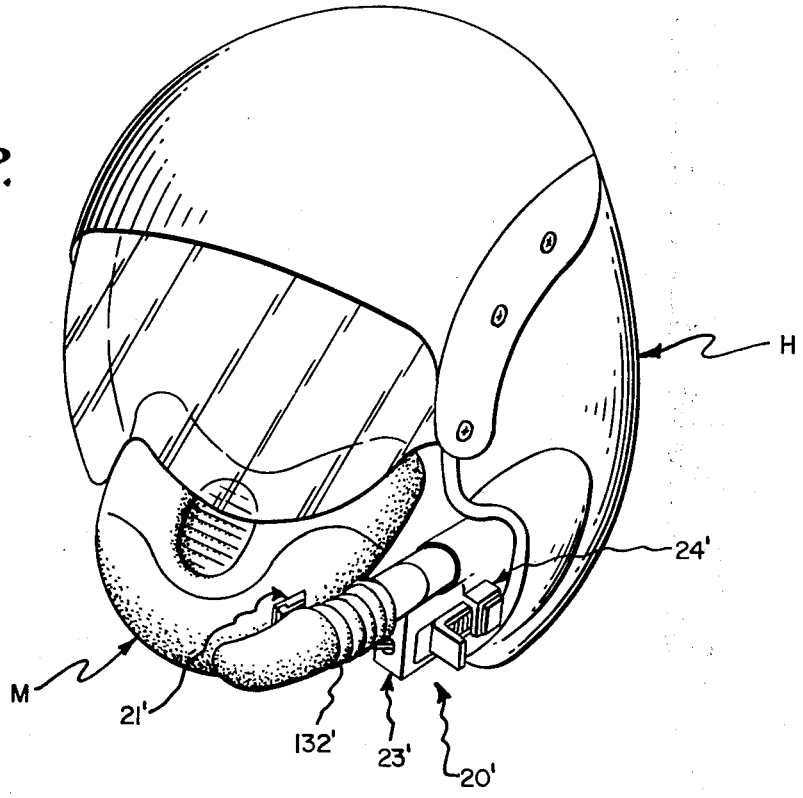
FIG. 2 is a perspective left front view of the pilot's helmet and mask depicted in FIG. 1, this view showing the second preferred embodiment of the inventive connecting device as releasably holding a left side portion of the mask to a left side portion of the helmet.

Referring collectively to the several drawing figures, and more particularly to FIGS. 1 and 2 thereof, the present invention broadly provides a connecting device which is adapted to releasably hold a first object to a second object. In FIG. 1, a first preferred embodiment of the inventive connecting device is generally indicated at 20, and is shown as releasably holding a right side portion of a first object, such as an oxygen mask M, to a right side portion of a second object, such as an aircraft pilot's helmet H. Similarly, in FIG. 2, a second presently preferred embodiment of the inventive connecting device is generally indicated at 20′, and is shown as releasably holding a left side portion of the mask M to a left side portion of the helmet H. However, while both embodiments 20, 20′ of the connecting device are illustrated and described in association with this mask and helmet, it is expressly contemplated that the present invention possesses general utility, apart from this particular environment, to releasably hold other types of first objects to other types of second objects. Accordingly, the present invention should not be construed as being limited to the particular end use herein illustrated and described, unless such limitation is expressly set forth in an appended claim.

Moreover, inasmuch as many of the structural features and elements of the second embodiment 20′ correspond to similar features and elements of the first embodiment 20, only such common features and elements of the first embodiment will be explicitly described, it being understood that the same reference numeral primed will serve to identify the corresponding feature or element of the second embodiment unless otherwise indicated.

For the reader's further convenience, as used herein, the directional terms "front" or "forward", "rear" or "rearward", "left", "right", "inside" or "inner", and "outside" or "outer", are each taken with reference to the pilot's head and mask in order that a uniform system or orientation may be adopted.

FIRST PREFERRED EMBODIMENT (FIGS. 1 and 3–15)

Figures 3, 4, 5, 6, 7, 8, 9:
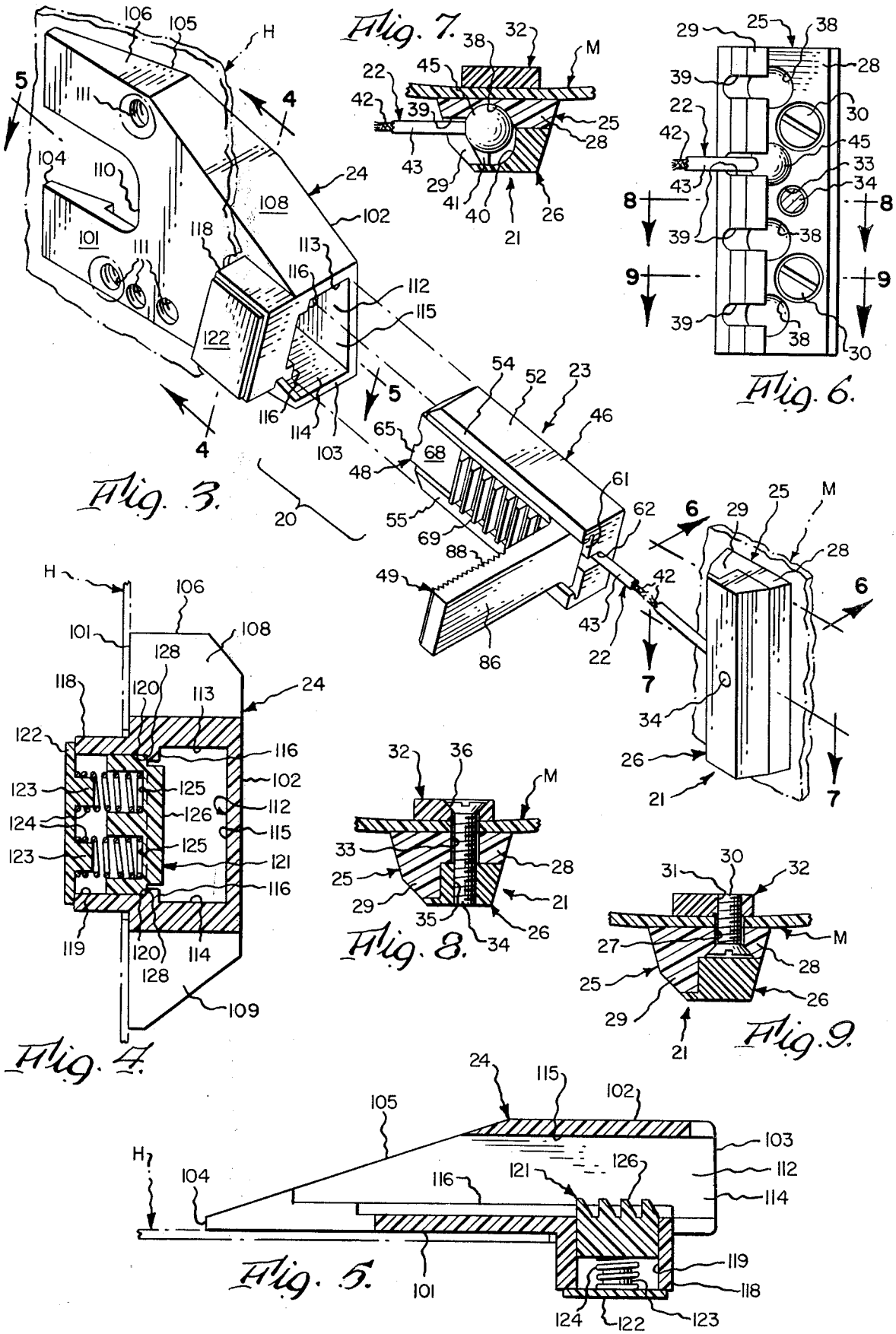
FIG. 3 is an enlarged fragmentary perspective view of the first preferred embodiment depicted in FIG. 1, this view illustrating the cable member operatively joining the anchor member and the male member, and further illustrating the male member in exploded aligned relation to the housing member passageway prior to insertion.
FIG. 4 is a further enlarged fragmentary sectional view of the housing member, taken generally on line 4—4 of FIG. 3, illustrating the female passageway and plunger in transverse cross-section.
FIG. 5 is a further enlarged fragmentary sectional view of the housing member, taken generally on line 5—5 of FIG. 3, illustrating the female passageway and plunger in longitudinal cross-section.
FIG. 6 is a further enlarged fragmentary vertical sectional view of the anchor member, taken generally on line 6—6 of FIG. 3, this view showing the anchor base member in side elevation.
FIG. 7 is a further enlarged fragmentary horizontal sectional view of the anchor member, taken generally on line 7—7 of FIG. 3, showing the cable member forward ball captured in a socket defined by the anchor base and cover members.
FIG. 8 is a fragmentary horizontal sectional view of the anchor base member, taken generally on line 8—8 of FIG. 6, this view also showing the cover member retained to the base member.
FIG. 9 is a fragmentary horizontal sectional view thereof, taken generally on line 9—9 of FIG. 6, showing the base member and back plate.

Referring now to FIGS. 1 and 3–15, and more particularly to FIG. 3 thereof, the first preferred embodiment 20 of the inventive connecting device is depicted as broadly including an anchor member, generally indicated at 21; a sheathed cable member, generally indicated at 22; a male member, generally indicated at 23; and a housing member, generally indicated at 24.

As best shown in FIGS. 3 and 6–8, the anchor member 21 includes a base member 25 adapted to be mounted on a right side portion of the mask, and a separable cover member 26 adapted to be mounted on the base member. Adverting now principally to FIGS. 6 and 9, the base member 25 is shown as being an integrally-formed vertically-elongated structural element having a substantially L-shaped transverse cross-section; and includes a leg portion 28 arranged generally parallel to the mask, and another leg portion 29 extending outwardly from the rear marginal end portion of leg portion 28. The leg portion 28 is shown provided with a pair of vertically-spaced holes, severally indicated at 27 (FIG. 9), through each of which a machine screw 30 may be passed to matingly engage tapped holes 31 provided in a back plate 32 positioned on the inside of the mask. Thus, each of screws 30 may be suitably tightened to draw the base member 25 and back plate 32 together, thereby compressing a portion of the mask therebetween. The base member leg portion 28 is shown further provided with another hole 33 (FIGS. 6 and 8) which is intended to accommodate passage of a machine screw 34 adapted to threadedly engage a tapped hole 35 provided through the cover member 26 and have its head portion engage a chamfered surface of hole 36 provided through the back plate 32. Thus, screw 34 may be suitably tightened to draw the cover member 26 into engagement with the base member 25. To this end, the cover member 26 is depicted as being a vertically-elongated member having a generally L-shaped transverse cross-section (FIG. 9) cooperatively configured to the shape of the base member.

Referring now to FIGS. 6 and 7, the base member leg portion 28 is shown configured to have a plurality of vertically-spaced concave recesses, severally indicated at 38, and the out-turned base member leg portion 29 is provided with a corresponding plurality of horizontal cable grooves, severally indicated at 39, each of which communicates with a recess 38. Similarly, the inside surface of cover member 26 is provided with a corresponding plurality of concave recesses, severally indicated at 40 (FIG. 7), each of which is adapted to define with one of base member recesses 38, a ball-receiving socket or chamber 41 for a purpose hereinafter explained.

Referring now principally to FIGS. 3, 6, 7 and 12, the cable member 22 is shown as including a central flexible metal cable 42 surrounded by a protective plastic sheath 43, and having a spherical balls 44, 45 suitably affixed to the rear and front marginal end portions of cable 42. It should be noted that cable front ball 45 is adapted to be captured within and restrained by one of anchor member ball-receiving sockets 41, with the cable passing through a cooperative groove 39, this being best shown in FIGS. 6 and 7.

Figures 10, 11, 12, 13, 14, 15:
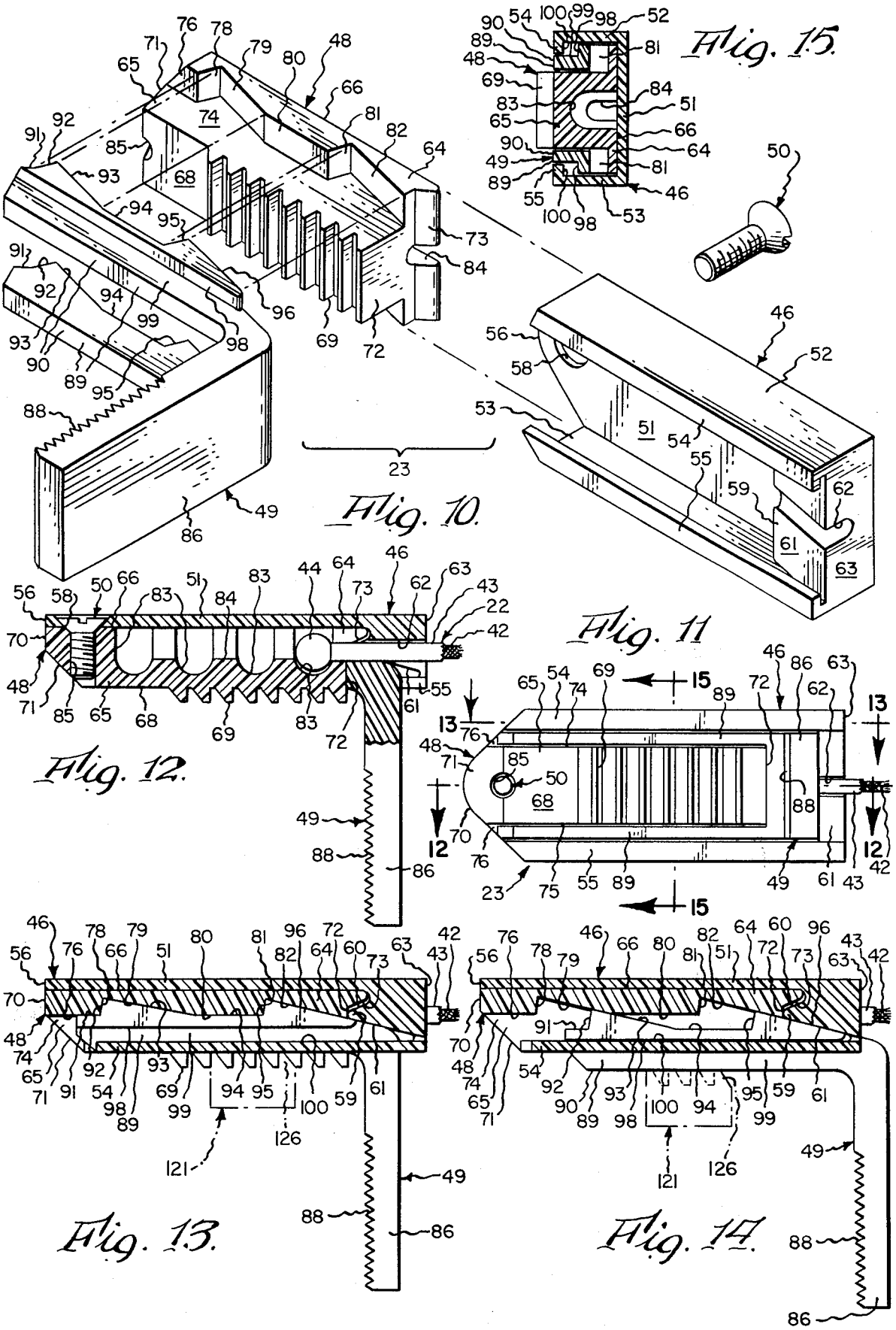
FIG. 10 is a further enlarged fragmentary perspective exploded view of the male member depicted in FIG. 3, this view principally showing the body member, the ratchet member, and the release member.
FIG. 11 is an enlarged fragmentary side elevation of the assembled male member shown in FIG. 3.
FIG. 12 is a fragmentary horizontal longitudinal sectional view of the male member, taken generally on line 12—12 of FIG. 11, this view principally illustrating the ball-receiving sockets and toothed rack of the ratchet member.
FIG. 13 is a fragmentary horizontal longitudinal sectional view of the male member, taken generally on line 12—12 of FIG. 11, this view principally illustrating the engaged cam and stop surfaces of the ratchet and release members.
FIG. 14 is a fragmentary horizontal longitudinal sectional view of the male member, this view being generally similar to the view of FIG. 13 but illustrating the release member as having been moved forwardly with respect to the ratchet member to conceal the teeth of the ratchet rack.
FIG. 15 is a fragmentary vertical sectional view thereof, taken generally on line 15—15 of FIG. 11, showing the assembled male member in transverse cross-section at an intermediate portion of its longitudinal extent.

As best shown in FIGS. 3 and 10, the male member 23 broadly includes a body member, generally indicated at 46; a ratchet member, generally indicated at 48; a release member, generally indicated at 49; and a machine screw 50.

Referring now principally to FIGS. 10, 11, 13 and 15, the body member 46 is depicted as being an integrally-formed horizontally-elongated generally rectangular-shaped structural element having an outwardly-opening substantially C-shaped transverse cross-section at an intermediate portion of its longitudinal extent (FIG. 15). Specifically, this body member 46 is illustrated as having a longitudinally-extending vertical inner wall 51, and longitudinally-extending upper and lower walls 52, 53 extending horizontally outwardly from the upper and lower marginal portions of inner wall 51, respectively, and terminating in a pair of longitudinally-extending in-turned upper and lower outer vertical flanges 54, 55, respectively. At its rearward end, the portion of inner wall 51 which extends beyond upper and lower walls 52, 53 is configured to have a rearward rounded nose 56 (FIG. 10), and is provided with a horizontal through hole 58 intended to accommodate passage of the shank portion of screw 50 (FIG. 12). At its forward end, the body member walls 51, 52 and 53 are joined by a transversely-extending solid back portion configured to have a rearwardly-extending convex nose 59 separating a vertical inwardly and forwardly inclined stop surface 60 from a vertical outwardly and rearwardly inclined cam surface 61 (FIG. 13). Moreover, this body member back portion is shown further provided with a central longitudinally-extending cable groove 62 passing through the back portion from its vertical front end face 63 to its rearward nose 59, this groove 62 being intended to accommodate passage of a portion of cable member 22.

The ratchet member 48 is best shown in FIG. 10 as being an integrally-formed horizontally-elongated structural element having a substantially T-shaped transverse cross-section at an intermediate portion of its longitudinal extent, and includes a vertical base portion 64 and a leg portion 65 extending horizontally outwardly therefrom. Referring now to FIGS. 12 and 13, this ratchet member 48 is further shown as having a vertical inner surface 66 adapted to engage the outwardly facing surface of body member inner panel 51; an outer surface including a rearward vertical planar portion 68 and a forward toothed rack 69; a rearward end face including a rounded convex vertical nose 70, and an outwardly and forwardly inclined planar surface 71; and a forward end face including a vertical surface 72 extending inwardly from the rear end of rack 69, and an inwardly and forwardly inclined stop surface 73 continuing inwardly therefrom to join inner surface 66 and adapted to engage body member stop surface 60. As best illustrated in FIG. 10, the outwardly extending leg portion 65 is provided with horizontal upper and lower surfaces 74, 75, respectively, extending inwardly from its outer surface to join a pair of upper and lower outwardly-facing vertical shelf surfaces, these being the outwardly facing surfaces of the leg portion 64. Each of these shelf surfaces is shown as including, rear to front in FIG. 10, a longitudinally-extending surface 76, an inwardly and forwardly inclined stop surface 78, an outwardly and forwardly inclined cam surface 79, a longitudinally-extending surface 80, an inwardly and forwardly inclined stop surface 81, and outwardly and forwardly inclined cam surface 82 joining the rear surface of the ratchet member. Moreover, this ratchet member 48 is provided with a plurality of longitudinally-spaced ball-receiving socket recesses, severally indicated at 83, which extends into ratchet member 48 from its inner surface 66. As best shown in FIG. 12, a longitudinally-extending cable groove 84 communicates each of these sockets 83 and extends forwardly to the ratchet member front end face (FIG. 10). This ratchet member 48 is shown further provided with a horizontal tapped through hole 85 adjacent its rear end, which hole 85 is arranged to register with body member hole 58. Thus, when holes 85 and 58 are so aligned, screw 50 may be passed through hole 58 to matingly engage with the ratchet member, and may be selectively tightened to hold the ratchet member 48 in this position on the body member 46 (FIG. 12). Referring specifically to FIG. 12, each of the teeth of ratchet rack 69 is shown configured to have a transversely-extending vertical forward surface, and an outwardly and forwardly inclined vertical rear surface.

Adverting now to FIG. 10, the release member 49 is depicted as being an integrally-formed structural element appearing generally L-shaped when viewed in top plan, and includes an outwardly-extending handle portion 86 provided with a roughened portion 88 on its rearward surface, and a pair of longitudinally-extending vertically-spaced upper and lower leg portions, severally indicated at 89. Still referring principally to FIG. 10, each of leg portions 89 is depicted as including a longitudinally-extending outer vertical surface 90, and a longitudinally-extending vertical inner surface cooperatively configured with the outwardly-facing shelf surfaces of the ratchet member 48. Specifically, the inwardly-facing inner surface of each of leg portions 89 includes, from rear to front in FIG. 10, a longitudinally-extending planar surface 91, an inwardly and forwardly inclined stop surface 92, an outwardly and forwardly inclined cam surface 93, a longitudinally-extending surface 94, an inwardly and forwardly inclined stop surface 95, and a forwardly and outwardly inclined cam surface 96. Moreover, release member leg portion cam surfaces 93, 96 are adapted to slidably engage the ratchet member cam surfaces 79, 82, respectively, when the male member is assembled, this being shown in FIG. 13. In this assembled position (FIG. 13), the release member leg portion stop surfaces 92, 95 are adapted to abuttingly engage toothed member stop surfaces 78, 81 to restrain further forward movement of the release member relative to the ratchet member. Adverting now to FIG. 10, the release member upper leg portion 89 is shown as further including an outwardly-facing longitudinally-extending planar vertical upper surface 98 extending upwardly beyond the upper surface 99 of the leg portion. Similarly, the release member lower leg portion 89 has an outwardly-facing longitudinally-extending planar vertical lower surface (not shown) extending downwardly beyond the lower surface of the lower leg portion. As best seen in FIGS. 13 and 14, each of release member leg portion surfaces 98 is adapted to engage an inwardly-facing surface 100 of body member flanges 54, 55 when the release member is moved forwardly on the body and ratchet members.

Referring now collectively to FIGS. 3 and 10–15, the male member 23 may be assembled by first positioning the rear ball 44 of cable member 22 in any desired one of ratchet member socket recesses 83 (FIG. 12) such that the cable portion passes through ratchet member cable groove 84 and body member cable groove 62. Thereafter, the release member may be positioned on the ratchet member such that release member cam surfaces 93, 96 engage toothed member cam surfaces 79, 82; and this subassembly may be slid forwardly into body member 46, and secured in this assembled position by engagement of screw 50 in tapped hole 85.

In this assembled condition, it should be noted that the ratchet member 48 and the body member 46 will be fixed together by virtue of screw 50 and contacting stop surfaces 60, 73. However the release member 49 may experience limited or restrained relative movement with respect to the connected body and ratchet members. Rearward relative movement of the release member 49 will be limited by the engagement of release member stop surfaces 92, 95 with ratchet member stop surfaces 78, 81. Forward relative movement of the release member will result in relative sliding movement between release member cam surfaces 93, 96 and ratchet member cam surfaces 79, 82 and body member cam surface 61, the effect of which relative forward sliding movement will be to cause release member outer surfaces 90, 90 to move outwardly beyond the teeth of ratchet rack 69, as shown in FIG. 14. Thus, if one were to look at the teeth of the rack 69 from a transverse direction, such teeth would extend beyond the release member when the release member was in a rearward position (FIG. 13), but would be concealed by such outward movement of the release member leg portions 89, 89 when the release member was moved forwardly with respect to the body member (FIG. 14).

Referring now principally to FIGS. 3–5, the housing member 24 is depicted as being a specially configured structural element having a longitudinally-extending outer vertical surface 101; a longitudinally-extending inner vertical surface 102; a transversely-extending vertical front end face 103; an opposite rear end face including a rearwardmost transversely-extending vertical surface 104, and an inwardly and forwardly inclined vertical surface 105; an upper surface including a rearwardmost longitudinally-extending horizontal surface 106, and a downwardly and forwardly inclined planar surface 108; and a longitudinally-extending horizontal bottom surface 109. This housing member 24 is shown provided with a recess, bounded by U-shaped surface 110, extending forwardly into the housing member from the rear end thereof, and also provided with a plurality of holes, severally indicated at 111, through which suitable fasteners (not shown) may be passed to mount the housing member on the helmet.

Moreover, this housing member is provided with an elongated female passageway, generally indicated at 112, having a substantially rectangular transverse outline or shape and adapted to slidably receive the insertable male member 23. Specifically, this female passageway 112 is bounded by an upper surface 113 arranged to face body member upper wall 52, a lower surface 114 arranged to face body member lower wall 53, an inner surface 115 arranged to face body member inner panel 51, and an outer surface 116 arranged to face the toothed rack 69 of the ratchet member 48. Moreover, this housing member is shown as including a raised rectangular collar 118 extending outwardly from housing member outer surface 101 and defining therewithin a rectangular passageway 119 communicating with the female passageway 112 and having outwardly-facing upper and lower shoulder surfaces 120, 120 (FIG. 4).

As best shown in FIGS. 4 and 5, a substantially rectangular plunger, generally indicated at 121, is shown as being slidably mounted in passageway 119 for inward and outward movement therealong. The open outer end of collar 118 is shown suitably closed by a cooperatively configured cover 122 provided with a spaced pair of raised cylindrical bosses 123, 123 extending into the passageway 119 from the inner surface of the cover. A pair of compression-type coil springs 124 have their outer marginal convolutions encircling cover bosses 123, 123 and have their inner marginal convolutions received in a pair of cylindrical recesses 125, 125 provided in the plunger. Moreover, this plunger 121 is shown as further including a toothed section 126 on its inner surface, which toothed section is adapted to function as a pawl to mate with ratchet rack 69. Thus, springs 124, 124 are arranged to act between the housing cover and the plunger to urge the plunger toothed section 126 to move inwardly into the female passageway 112 to matingly engage toothed rack 69 when the male member 23 is inserted into the female passageway 112. As may be best seen in FIG. 4, the extent of such inward movement of biased plunger 121 is limited by engagement of inwardly-facing upper and lower plunger surfaces 128, 128 with outwardly-facing housing member shoulder surfaces 120, 120.

In operation, the anchor member 21 is initially mounted on the first object, such as a portion of the mask M, and the housing member 24 is initially mounted on the second object, such as a portion of helmet H, as generally shown in FIG. 1.

The operator may then selectively remove anchor cover member 26 and position the cable member forward ball 45 in any desired one of the vertically-spaced anchor recesses 38. Thereafter, the cover member 26 may be replaced on the base member such that cable member ball 45 will be captured in such desired one of the anchor member ball-receiving sockets 41.

If necessary, the operator may disassemble the male member 23 to adjustably position the cable member rear ball 44 in any desired one of the ratchet member ball-receiving sockets 83 to provide a coarse or rough adjustment of the cable length.

After these initial adjustments have been made, as necessary, the operator need only slidably insert the male member 23 into the housing member female passageway 112 such that the toothed pawl section 126 of the biased plunger 121 will matingly engage with the teeth of ratchet rack 69. Since the rear surfaces of each of the rack teeth are forwardly and outwardly inclined, and the rear surfaces of the pawl teeth are cooperatively configured, the male member 23 may be selectively inserted into the housing member passageway 112 to provide a fine adjustment of cable length. Hence, the operator may slidably insert the male member 23 into female passageway 112 as far as desired, and the male member cannot be withdrawn therefrom without first disengaging the mating teeth of ratchet rack 69 and pawl section 126.

The operator may selectively remove the inserted male member 23 from the passageway 112 by first sliding the release member forwardly on the body and ratchet members, as shown in FIG. 14. The effect of this forward sliding movement is to cause release member leg portion outer surfaces 90, 90 to move outwardly beyond the teeth of rack 69 to engage the teeth of plunger 121, and to cause the plunger to retract into housing member passageway 119, thereby disengaging the pawl teeth from the rack teeth and enabling the male member to thereafter be withdrawn from the housing member.

SECOND PREFERRED EMBODIMENT (FIGS. 2 and 15–17)

As previously noted, the second presently preferred embodiment 20' of the connecting device may also be used to releasably hold a first object to a second object, albeit that this second embodiment is particularly adapted to hold a left side portion of mask M to a left side portion of helmet H, as shown in FIG. 2.

Inasmuch as this second embodiment 20' contains many features and structural elements in common with the first preferred embodiment 20 heretofore described, the same reference numeral primed will be used to identify such corresponding features and structural elements in the second embodiment which have been previously described.

The second embodiment 20' is shown as being generally similar to the first embodiment, and broadly includes: an anchor member, generally indicated at 21' and corresponding to anchor member 21, having a base member 25' adapted to be secured to a left side portion of the mask, and having a separable cover member 26'; a flexible cable member, generally indicated at 22' and corresponding to cable member 22; a male member, generally indicated at 23' and corresponding to male member 23 except as hereinafter indicated, and having a body member 46', a ratchet member 48' and a release member 49'; and a housing member, generally indicated at 24' and corresponding to housing member 24 except as hereinafter indicated, and having a female passageway 112' into which male member 23' may be inserted.

The principal structural differences between the first and second embodiments lie in the external configurations of the body member 46' and the housing member 24'. These differences are provided to additionally permit fluid and electrical communication between the mask and helmet, as will now be explained.

Figure 16:
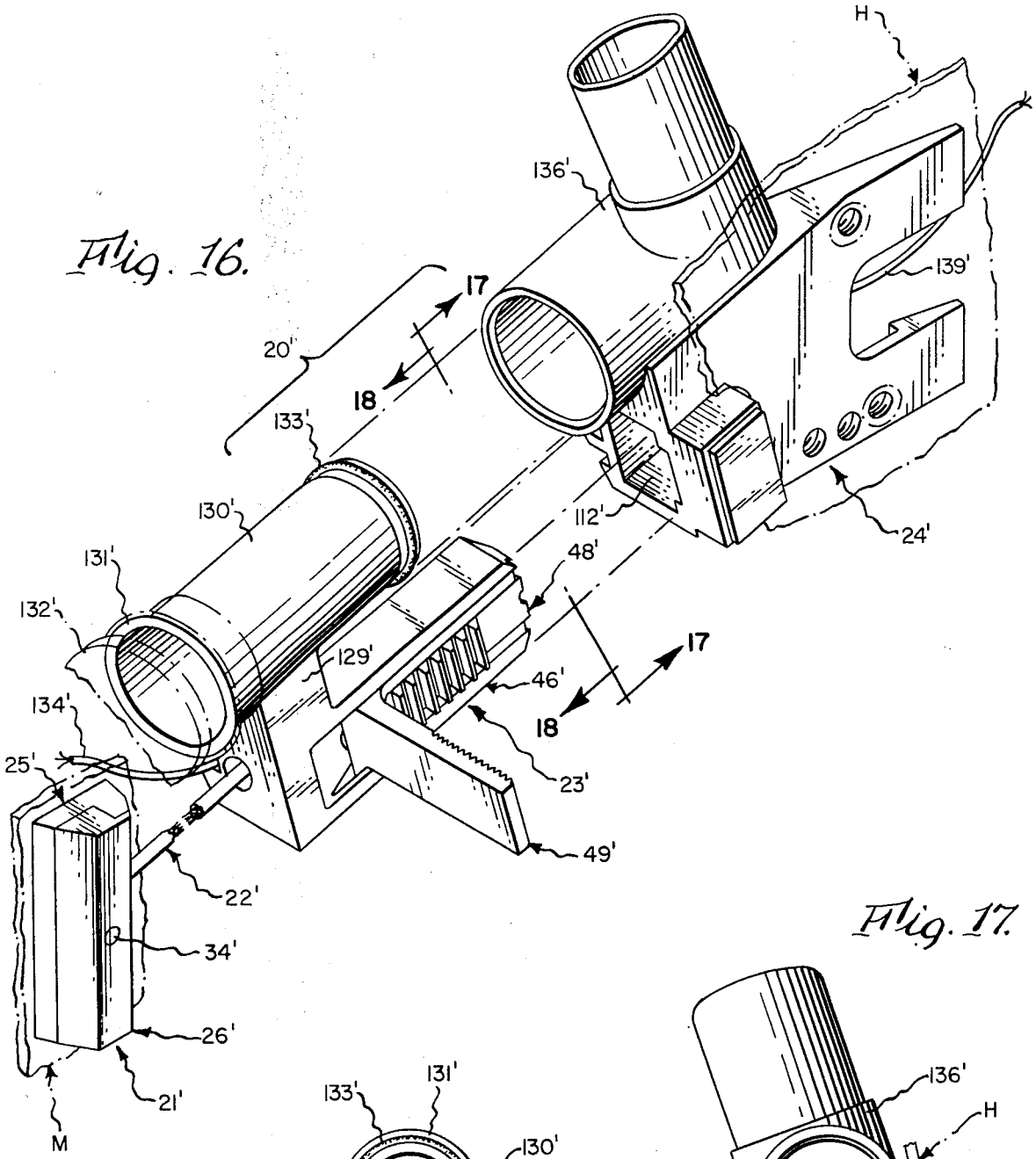
FIG. 16 is an enlarged fragmentary perspective view of the second preferred embodiment depicted in FIG. 2, this view illustrating the cable member operatively joining the anchor member and the male member, and further illustrating the male member in exploded aligned relation to the housing member female passageway prior to insertion.
Figure 18:
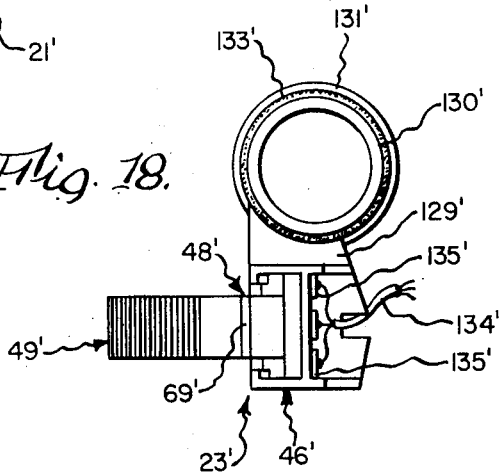
FIG. 18 is a fragmentary rear elevation of the male member and taken generally on line 18—18 of FIG. 16, this view particularly illustrating the tube section and electrical terminals.

Referring now to FIGS. 16 and 18, the body portion 46' is shown further provided with a neck portion 129' extending upwardly from its upper surface, which neck portion 129' is arranged to support a tube section 130'. The forward marginal end portion of this tube section is provided with a peripheral bead 131' about its open end, and is adapted to receive the forward marginal end portion of an oxygen supply hose 132'. At a marginal portion adjacent its opposite rear end, the tube section 130' is provided with an annular groove in which an O-ring 133' is arranged. Moreover, a three-wire electrical cable 134' is shown leading to the body member and connected to three spaced electrical terminals, severally indicated at 135' in FIG. 18.

Figure 17:
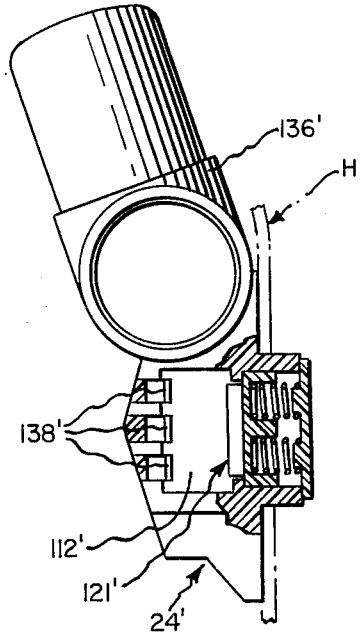
FIG. 17 is a fragmentary front elevation of the housing member, taken generally on line 17—17 of FIG. 16, with portions of the housing member broken away to illustrate the plunger therewithin.

Referring now to FIGS. 16 and 17, the housing member 24' is shown as additionally including a tubular elbow 136' which is adapted to slidably receive through its forward open end, the rearward marginal portion of tube section 130'. Of course, the upper open end of this elbow 136' is adapted to communicate with a suitable oxygen supply conduit (not shown). Moreover, this housing member 24' is shown as further including three spaced contact clips, severally indicated at 138', which are arranged in passageway 112' and function as electrical terminals for a circuit including two wire cable 139'.

Thus, the male member 23' may be similarly inserted into the female passageway 112' to releasably hold a left side portion of the mask to a left side portion of the helmet. Of course, during such connection, the marginal rear end portion of tube section 130' will be slidably inserted into the front marginal end portion of elbow 136' to complete a fluid passageway leading to the mask, and the electrical terminals 135' will contact terminals 138' to establish electrical communication between the helmet and mask. Desirably, such electrical connection may include the pilot's mask-mounted microphone (not shown).

Except as indicated hereinabove, the second embodiment 20' functions as the first embodiment 20 to releasably hold a left side portion of the mask to a left side portion of the helmet.

Accordingly, both embodiments 20, 20' of the inventive connecting device are generally adapted to releasably hold a first object to a second object, and are particularly suited to releasably hold an oxygen mask to a pilot's helmet. Within this latter environment, either embodiment affords the capability of vertical adjustment, as by the variable positioning of the forward cable ball in any desired one of the anchor member sockets; longitudinal adjustment, as by the coarse adjustment of the rear cable ball in any one of the ratchet member ball-receiving recesses, and the fine adjustment determined by the extent to which the male member is inserted into the female passageway; and pivotal adjustment, as through flexure of the cable member.

Moreover, it should be clearly understood that the combination of the housing and male members possesses general utility apart from the illustrated environment of the first and second presently preferred embodiments. In this simplified form, the housing member may be mounted on, or connected to, one of the objects, and the male member may be mounted on, or connected to, the other of the objects. In operation, the cooperative engagement of the male and housing members will be the same as heretofore described. Therefore, while in the presently preferred embodiments herein illustrated and described, the housing members are shown as being specially configured for attachment to the helmet, it should be understood that this particular shape of the housing member need not be provided for all possible end uses. As an alternative to the plunger, the toothed sector may be mounted on one end of a leaf spring.

The various component parts of the presently preferred embodiments 20, 20' have been described as being integrally-formed, and illustrated as being so formed of a suitable plastic material, such as a polycarbonate plastic. However, these various component parts may be alternatively formed of other materials, such as a suitable metal, or formed as subassemblies, as desired. If desired, the anchor base member may be formed integrally with the mask.

While two presently preferred embodiments of the inventive connecting device have been shown and described, it will be understood by persons having ordinary skill in this particular art that various changes and modifications may be made without departing from the spirit of the invention which is generically defined by the following claims:

What is claimed is:

1. A connecting device adapted to releasably join a first object to a second object, comprising:

a housing member operatively connected to one of said objects and provided with a female passageway, said housing member having a toothed section biased to move into said female passageway; and a male member operatively connected to the other of said objects and adapted to be selectively inserted into said female passageway, said male member having a toothed rack adapted to matingly engage said toothed section to prevent unintended withdrawal of said male member from said female passageway and having at least one first cam surface mounted to move with said rack, said male member also having a release member mounted for movement relative to said rack and having an operative surface and at least one second cam surface arranged to engage said first cam surface such that said release member may be moved relative to said rack to cause said operative surface to extend beyond the teeth of said rack;

whereby an operator may join said objects by selectively inserting said male member into said female passageway such that said toothed section will matingly engage said toothed rack, and may release said objects by selectively moving said release member relative to said rack to cause said operative surface to overcome the bias of said toothed section to disengage said toothed section from said rack and to permit said male member to be withdrawn from said female passageway.

2. A connecting device as set forth in claim 1 wherein said housing member is provided with another passageway communicating with said female passageway, and wherein said toothed section is provided on a plunger slidably mounted in such other passageway for movement toward and away from said female passageway, and further comprising at least one spring operatively arranged to act on said plunger and housing member to bias said plunger to move toward said female passageway.

3. A connecting device as set forth in claim 1 wherein said male member includes a body member and a ratchet member mounted on said body member, and wherein said release member is mounted for movement relative to said body and ratchet members.

4. A connecting device as set forth in claim 3 wherein said ratchet member is provided with said first cam surface.

5. A connecting device as set forth in claim 3 wherein said ratchet member is operatively connected to the other of said objects.

6. A connecting device as set forth in claim 3 wherein said male member includes at least two of said first cam surfaces, at least one of said first cam surfaces being provided on said ratchet member and another of said first cam surfaces being provided on said body member.

7. A connecting device as set forth in claim 6 wherein said male member includes a corresponding plurality of said second cam surfaces arranged to engage said first cam surfaces.

8. A connecting device as set forth in claim 1 wherein the teeth of said rack are configured to act as a ratchet, and the teeth of said section are cooperatively configured to act as a pawl to enable said male member to be slidably inserted into said female passageway a selected distance, but to prevent withdrawal of said male member from said female passageway.

9. A connecting device as set forth in claim 1 and further comprising an anchor member provided with a plurality of spaced ball-receiving recesses, and a cable member having one marginal end portion secured to said male member and having a ball at its other marginal end portion, and wherein said ball may be adjustably positioned in any desired one of said anchor member recesses.

10. A connecting device as set forth in claim 1 wherein said male member is provided with a plurality of spaced ball-receiving recesses, and further comprising a cable member having one marginal end portion secured to such other object and having a ball at its other marginal end portion, and wherein said ball may be adjustably positioned in any of said male member recesses.

11. A connecting device as set forth in claim 10 wherein said male member includes a body member and a ratchet member, and wherein said ball-receiving recesses are provided in said ratchet member.

12. A connecting device as set forth in claim 1 wherein said first object is a mask and said second object is a helmet, and wherein said housing member further includes one portion of an oxygen supply conduit, and wherein said male member includes another portion of said oxygen supply conduit, such other conduit portion being adapted to communicate with said one conduit portion when said male member is inserted into said female passageway.

13. A connecting device as set forth in claim 12 wherein said housing member further includes at least one terminal of an electrical circuit, and wherein said male member further includes at least one other terminal of said circuit, and wherein said terminals are adapted to contact one another to complete said electrical circuit when said male member is inserted into said female passageway.

* * * * *